US008714085B2

(12) United States Patent
Kolbe et al.

(10) Patent No.: US 8,714,085 B2
(45) Date of Patent: May 6, 2014

(54) SURFACE WITH A SURFACE STRUCTURE FOR CONTACTING PRINTING MATERIAL, MACHINE FOR PROCESSING MATERIAL AND METHOD FOR PRODUCING AREAS WITH A SURFACE STRUCTURE

(75) Inventors: Wolfram Kolbe, Heidelberg (DE); Frank Schaum, Neckargemünd (DE); Harrie G. Knol, Geesteren (NL)

(73) Assignee: Heidelberger Druckmaschinen AG, Heidelberg (DE)

( * ) Notice: Subject to any disclaimer, the term of this patent is extended or adjusted under 35 U.S.C. 154(b) by 1155 days.

(21) Appl. No.: 12/122,276

(22) Filed: May 16, 2008

(65) Prior Publication Data

US 2008/0282916 A1 Nov. 20, 2008

(30) Foreign Application Priority Data

May 16, 2007 (DE) ..... 10 2007 023 117

(51) Int. Cl.
*B41F 13/24* (2006.01)

(52) U.S. Cl.
USPC ..... 101/232; 101/416.1; 101/417; 101/419; 101/420

(58) Field of Classification Search
CPC .... B65H 27/00; B65H 2601/251; B41F 22/00
USPC ..... 101/232, 150, 416.1, 417, 419, 420; 400/641
See application file for complete search history.

(56) References Cited

U.S. PATENT DOCUMENTS

| | | | | |
|---|---|---|---|---|
| 4,033,059 | A * | 7/1977 | Hutton et al. | 283/91 |
| 4,158,567 | A * | 6/1979 | Honma et al. | 430/307 |
| 6,766,738 | B2 | 7/2004 | Blümm et al. | |
| 7,580,154 | B2 * | 8/2009 | Samworth | 358/3.06 |
| 7,690,300 | B2 * | 4/2010 | Braun et al. | 101/401.1 |
| 7,827,907 | B2 * | 11/2010 | Koivukunnas et al. | 101/32 |
| 2005/0284315 | A1 * | 12/2005 | Yu et al. | 101/154 |
| 2008/0227656 | A1 * | 9/2008 | Besenbacher et al. | 506/10 |

FOREIGN PATENT DOCUMENTS

| | | |
|---|---|---|
| CA | 2 260 470 A1 | 7/1999 |
| DE | 28 20 549 A1 | 1/1979 |

(Continued)

OTHER PUBLICATIONS

German Patent and Trademark Office Search Report, dated Sep. 5, 2007.

*Primary Examiner* — Matthew G Marini
*Assistant Examiner* — Allister Primo
(74) *Attorney, Agent, or Firm* — Laurence A. Greenberg; Werner H. Stemer; Ralph E. Locher

(57) ABSTRACT

A surface, especially a galvanically molded transport cylinder sleeve, has a surface structure for contacting printing material, in particular sheets of paper. The surface structure includes first structural elevations spaced apart from each other by a minimum distance A1 and having a height B1 and second structural elevations spaced apart from each other by a minimum distance A2 and having a height B2 with B2<B1. A ratio between the distances A1 and A2 ranges between 10:1 and 1:1. The surface has support areas for supporting the printing material. The printing material is prevented from contacting a planar horizontal surface between the support areas of first, higher structural elevations due to second, lower structural elevations with support areas thereof that are formed between the first, higher structural elevations. A machine for processing printing material and a method for producing areas with a surface structure, are also provided.

17 Claims, 2 Drawing Sheets

(56) References Cited

FOREIGN PATENT DOCUMENTS

| | | | |
|---|---|---|---|
| DE | 29 14 255 | A1 | 11/1979 |
| DE | 39 31 479 | A1 | 4/1991 |
| DE | 198 03 787 | A1 | 8/1999 |
| DE | 100 63 171 | A1 | 6/2002 |
| GB | 2 022 016 | A | 12/1979 |
| GB | 2 236 508 | A | 4/1991 |
| JP | 58128027 | U | 8/1983 |
| WO | 2006/112696 | A2 | 10/2006 |

* cited by examiner

SURFACE WITH A SURFACE STRUCTURE FOR CONTACTING PRINTING MATERIAL, MACHINE FOR PROCESSING MATERIAL AND METHOD FOR PRODUCING AREAS WITH A SURFACE STRUCTURE

CROSS-REFERENCE TO RELATED APPLICATION

This application claims the priority, under 35 U.S.C. §119, of German application DE 10 2007 023 117.4, filed May 16, 2007; the prior application is herewith incorporated by reference in its entirety.

BACKGROUND OF THE INVENTION

Field of the Invention

The present invention relates to a surface with a surface structure for contacting printing material, including first structural elevations that are spaced apart by a minimum distance A1 and have a height B1, and second structural elevations that are spaced apart by a minimum distance A2 and have a height B2, wherein B2<B1. The present invention also relates to a machine for processing printing material, in particular a printing press or a sheet-fed rotary printing press for lithographic offset printing. Moreover, the present invention relates to a method of galvanically producing areas that have a surface structure by forming electrically insulating areas that are spaced apart from each other on an electrically conductive substrate.

In machines that process printing material, for example in printing presses, the printing material is conveyed along a transport path and is processed, in particular printed. In that context, it has become known heretofore to convey the printing material, for example sheets of paper, using transport cylinders (transfer cylinders, reversing cylinders, impression cylinders) that carry cylinder jackets with structured surfaces, i.e. surfaces that have raised structures. The structuring of the cylinder jackets reduces the contact area between the printing material and the jacket, in particular to prevent ink from smearing off on the cylinder jackets when sheets that have been printed and reversed are being transported. In addition, the structural elevations of the surface structure fix the printing material to prevent it from moving relative to the cylinder jacket, thus avoiding damage to the printed image.

German Published, Non-Prosecuted Patent Application DE 39 31 479 A1 describes a foil as a jacket. The foil has a chemically durable, wear-resistant, incompressible carrier layer made, for example, of nickel or chromium and including spheres of identical height or a roughening with silicone coating. The coating of the foil is intended to further increase the ink-repellent property of the foil and to effectively prevent ink smearing.

German Published, Non-Prosecuted Patent Application DE 100 63 171 A1, corresponding to U.S. Pat. No. 6,766,738, describes a cylinder jacket profile for impression cylinders or sheet-guiding cylinders in sheet-fed printing presses, preferably perfecting presses. The cylinder jacket profile includes structural elevations that are evenly distributed and has a surface coating with easy-cleaning properties. The structural elevations are spaced apart relative to each other by approximately between 20 and 100 μm. The easy-cleaning layer is a roughened microstructure of between 10 nm and 2 μm and is located on top of the structural elevations.

German Published, Non-Prosecuted Patent Application DE 198 03 787 A1 describes a structured surface with hydrophobic properties. The structured surface can be produced, for example, by galvanic separation, and has structural elevations with a height of between 50 nm and 10 μm and an average spacing of between 50 nm and 100 μm. The structural elevations can be applied to a superstructure of an average height of between 10 μm and 1 mm and an average spacing of between 10 μm and 1 mm.

Furthermore, International Publication No. WO 2006/112696 A2 discloses a method of electroforming structured surfaces that can, in particular, be used as surfaces that guide printing material in printing presses. The disclosed production method provides the possibility to specifically adjust the spacing, shape and height of structural elevations in a structure. For that purpose, electrically insulating areas (circular photoresist areas) are applied to an electrically conductive substrate, and those areas are electroplated. The result is a hole structure that is again electroplated to form a surface structured with a hill-and-valley structure. The distances between the structural elevations (hills) correspond to the distances between the photoresist areas. The crater shape and, in particular, the height of the hills can be specifically influenced by controlling the electroplating process.

When such structured surfaces are produced, by choosing an appropriate spacing between the photoresist areas, the distance between the individual structural elevations can be selected to be large enough for the structured surface to have as few points of contact with the printing material as possible per unit of surface area. If the respective supporting areas of the individual structural elevations are reduced as well, a re-splitting of the ink and damage to the printed image due to puncture marks caused by the structural elevations (also known as "white dots"), can be reduced. If, on the other hand, the distances between the structural elevations are too long, the printing material tends to come into contact with the surface between the structural elevations. Thus, at those points of contact, ink smearing may occur.

BRIEF SUMMARY OF THE INVENTION

It is accordingly an object of the invention to provide a surface for contacting printing material, which overcomes the hereinafore-mentioned disadvantages of the heretofore-known contact surfaces of this general type and which has a surface structure suitable for reliably guiding printing material without damaging or impairing a printed image.

It is also an object of the invention to provide a machine for processing printing material, in particular a printing press or a sheet-fed rotary printing press for lithographic offset printing, having at least one surface for contacting the printing material.

It is a further or alternative object of the present invention to provide an improved method of galvanically producing surfaces with a surface structure in order to easily produce surfaces that are constructed in such a way that printing material can be conveyed in a reliable way without damage.

With the foregoing and other objects in view there is provided, in accordance with the invention, a surface with a surface structure for contacting printing material. The surface comprises first structural elevations being mutually spaced apart by a minimum distance A1 and having a height B1, second structural elevations being mutually spaced apart by a minimum distance A2 and having a height B2, wherein B2<B1, and a ratio between the distances A1 and A2 ranging between 10:1 and 1:1.

Thus, in accordance with the invention, a surface for contacting printing material has a surface structure that includes high and low structural elevations, with low structural elevations (structural elevations with the height B2) being located between the high structural elevations (structural elevations with the height B1). However, the low structural elevations are not formed as a substructure on a suprastructure, as described in the prior art. Instead, they are spaced apart with respect to each other by distances that range between the same order of magnitude as the distances between the high structural elevations and approximately one tenth of the distances between the high structural elevations. Thus, the surface structure is advantageously distinguished by an alternation of high and low structural elevations that are spaced apart from each other. Consequently, a printing material that is supported by the high structural elevations cannot come into contact with the planar space between the high structural elevations, due to the low structural elevations present therebetween. As a result, undesired smearing of the ink between the high structural elevations can be effectively avoided and the creation of so-called "white dots" is reduced.

In accordance with another feature of the invention, the relationship between the distances A1 and A2 may, in particular, range between 5:1 and 1:1, preferably between 3:1 and 1:1. In a particularly preferred embodiment, the relationship ranges between 2:1 and 1:1. In accordance with a simple embodiment, one low structural elevation is provided between each two high structural elevations.

In accordance with a further feature of the invention, the minimum distance A1 is preferably defined as an average distance between adjacent first structural elevations, and the minimum distance A2 is preferably defined as an average distance between adjacent second structural elevations. In this context, "adjacent structural elevations" is understood to refer to structural elevations that are closest together and have substantially the same height.

In accordance with an added feature of the invention, planar horizontal areas are formed between the structural elevations. This means, in particular, that the structural elevations, which widen at the base, or rather the curved portions thereof, do not merge directly with each other but are separated by planar horizontal areas.

In accordance with an additional feature of the invention, the distances A1 and A2 range between approximately 50 μm and approximately 500 μm, preferably between approximately 50 μm and approximately 200 μm.

In accordance with yet another feature of the invention, the height B1 ranges between approximately 5 μm and approximately 50 μm, preferably between approximately 10 μm and approximately 30 μm, and the height B2 ranges between approximately 2 μm and approximately 25 μm, preferably between approximately 5 μm and approximately 15 μm.

In accordance with yet a further feature of the invention, the first structural elevations include first support areas with first effective support surfaces C1 and the second structural elevations include second support areas with second effective support surfaces C2, with C1 ranging between approximately 3 $\mu m^2$ and approximately 30 $\mu m^2$ and C2 ranging between approximately 1 $\mu m^2$ and approximately 5 $\mu m^2$. The meaning of "effective support surface" will be explained in more detail below in connection with FIG. 4.

With the objects of the invention in view, there is also provided a machine for processing printing material, in particular a printing press or a sheet-fed rotary printing press for lithographic offset printing, comprising at least one surface for contacting printing material as described above with respect to the invention. Such a surface is preferably provided on a cylinder for guiding printing material.

With the objects of the invention in view, there is furthermore provided a method for electroforming surfaces or galvanically producing areas having a surface structure. The method comprises forming mutually spaced apart first and second electrically insulating areas on an electrically conductive substrate, providing the first electrically insulating areas with a diameter D1 and a minimum distance A1 therebetween, providing the second electrically insulating areas with a diameter D2 and a minimum distance A2 therebetween, and providing a ratio between the distances A1 and A2 ranging between 10:1 and 1:1 with D2<D1.

Structural elevations of different height (preferably high structural elevations and low structural elevations) can be created due to the formation of electrically insulating areas of different diameters, by carrying out the method of the invention. In addition, the structural elevations are disposed in such a way as to be spaced apart from each other in accordance with the invention in a manner as described above with reference to the surface of the invention.

In accordance with another mode of the method of the invention, the substrate is submerged in a galvanic bath, the electrically insulating areas are at least partly galvanically overgrown (in other words: electroplated), a resultant hole structure is electroformed (in other words: galvanically molded or used as an electroforming die) and a resultant surface with a surface structure is separated from the hole structure.

In accordance with a concomitant mode of the method of the invention, the resultant surface having a surface structure is electroformed to form an electroforming die for producing a surface family, i.e. a plurality of surfaces formed with the die.

Other features which are considered as characteristic for the invention are set forth in the appended claims. Any desired combination of the invention and the advantageous developments of the invention described above also present advantageous developments of the invention.

Although the invention is illustrated and described herein as embodied in a surface with a surface structure for contacting printing material, a machine for processing printing material and a method for producing areas with a surface structure, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE DRAWING

Figure 1:
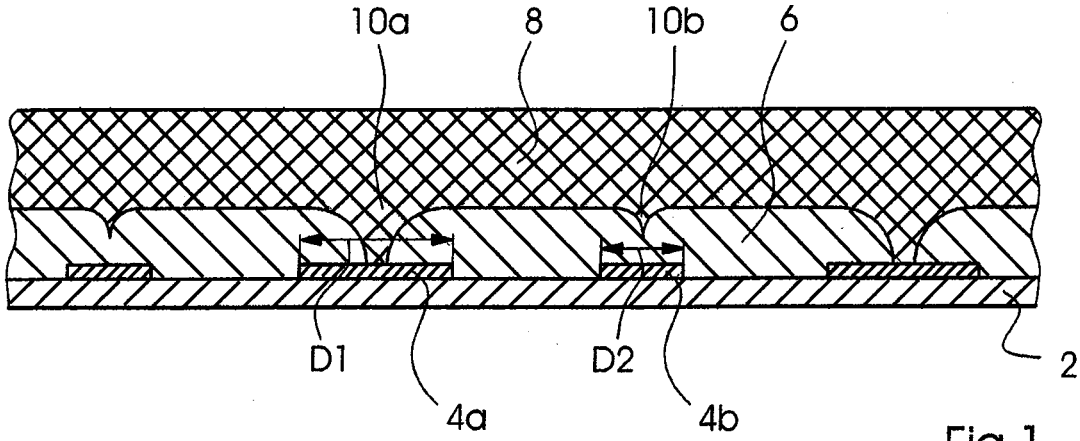
FIG. 1 is a fragmentary, diagrammatic, sectional view of a preferred exemplary embodiment of a surface according to the invention at a production stage.

Referring now in detail to the figures of the drawings, in which identical elements are designated by identical reference numerals and first, particularly, to FIG. 1 thereof, there is seen a preferred exemplary embodiment of a surface according to the invention which includes an electrically conductive substrate 2 with electrically insulating areas 4*a* and 4*b* formed thereon. The areas 4*a* have a diameter D1 that is larger than a diameter D2 of the areas 4*b*. The areas 4*a* and 4*b* are preferably made of so-called photoresist and are substantially circular. The diameters D1 and D2 are to be understood as average diameters of the corresponding circular areas 4*a* and 4*b*. The diameter D1 of the larger areas may preferably range between approximately 75 μm and approximately 100 μm, whereas the diameter D2 of the smaller areas may preferably range between approximately 30 μm and approximately 70 μm.

The electrically insulating substrate 2 with the electrically insulating areas 4*a* and 4*b* formed thereon is then submerged in a galvanic bath. In the galvanic bath, the electrically insulating areas 4*a* and 4*b* are overgrown as shown in FIG. 1, thus creating a hole structure 6, for example made of nickel. This hole structure 6 may subsequently be passivated and cast in nickel in a galvanic bath. The result is a cylinder surface 8 with a structured surface that can be removed from the hole structure 6 in a subsequent step.

In the process, the holes in the hole structure 6 and structural elevations 10*a* and 10*b* of the surface 8 can be adjusted in any specific desired way. For this purpose, the diameters D1 and D2 of the electrically insulating areas 4*a* and 4*b* and distances A1 and A2 between the electrically insulating areas 4*a* and 4*b* can be varied appropriately and the galvanizing process, in particular its duration, can be controlled in a suitable way. A creation of first structural elevations 10*a* and second structural elevations 10*b* is attained by overgrowing the electrically insulating areas 4*a* and 4*b*, with the first (high) structural elevations 10*a* being higher than the second (low) structural elevations 10*b*.

Having been removed from the hole pattern structure 6, the surface 8 may be passivated, for example using chromium, and electroformed again. A copy die that is created in this way may be used for producing a family of surfaces 8 having a surface structure, so that based on the copy die, a plurality of surfaces with a surface structure can be created by electroforming. Reference is made, in particular, to the teaching of International Publication No. WO 2006/112696 A2 in terms of the electroplating process and the creation of a family of structured surfaces.

Figure 2:
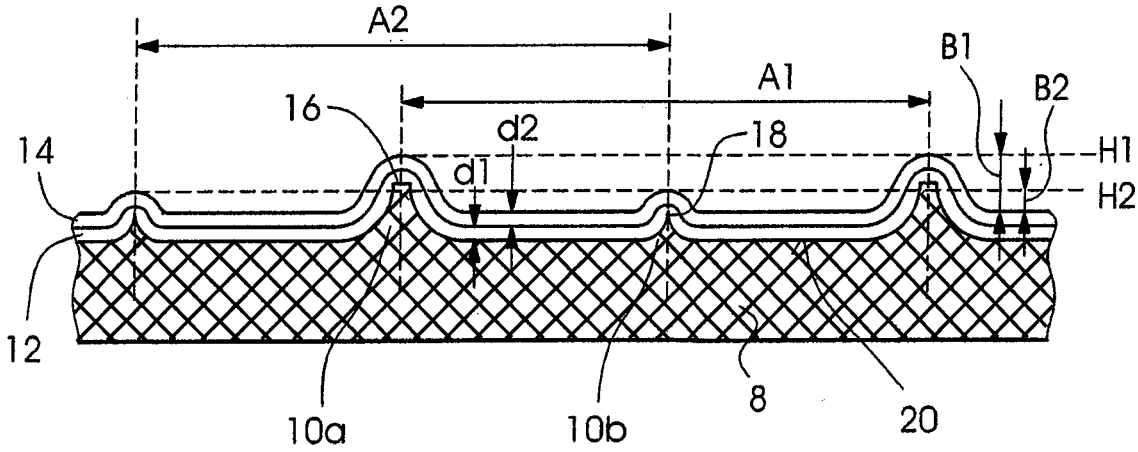
FIG. 2 is a fragmentary, diagrammatic, sectional view of a preferred exemplary embodiment of a surface according to the invention.

FIG. 2 shows a surface 8 with a surface structure that has been created in the manner described above. The structured surface, in particular the structural elevations 10*a* and 10*b*, have been provided with a coating 12, preferably a coating of nickel and additionally chromium or exclusively chromium, and an ink-repellent seal 14, preferably silicone or a so-called sol-gel.

FIG. 2 also shows that the first structural elevations 10*a* have planar support surfaces 16, whereas the second structural elevations 10*b* do not have any such planar support surface but rather pointed tips 18. Whether the support areas of the first and second structural elevations 10*a* and 10*b* are formed as planar support surfaces or pointed tips depends on the diameters of the electrically insulating areas 4*a* and 4*b* and on the control of the timing, in particular of the duration, of the galvanization process. In contrast to what is shown in FIGS. 1 and 2, it is thus possible for the structural elevations 10*a* to have pointed tips instead of the substantially planar support surfaces 16.

Figure 3:
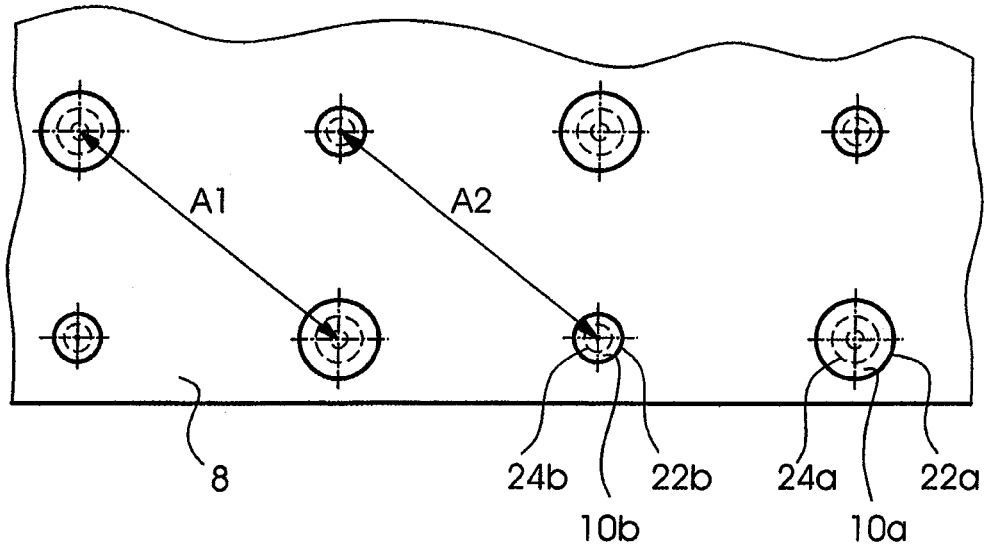
FIG. 3 is a top-plan view of a preferred exemplary embodiment of a surface according to the invention.

FIG. 2 illustrates the surface 8 with first structural elevations 10*a* that are disposed at a minimum distance A1 from each other. In this context, the minimum distance A1 is to be considered an average distance between adjacent structural elevations. With reference to FIG. 3, it should be noted that "adjacent structural elevations" indicate a structural elevation and the closest structural elevation of equal height. FIG. 2 furthermore illustrates that the surface 8 has second structural elevations 10*b* that are disposed at a minimum or average distance A2 from adjacent structural elevations. In the illustrated exemplary embodiment, the distance or spacing A2 is substantially the same as the distance or spacing A1, i.e. the ratio between the distances A1 and A2 in this exemplary embodiment is 1:1. Alternatively, there may be several second structural elevations 10*b* between the first structural elevations 10*a*, preferably two, three, or four (up to ten in accordance with the invention) of such second structural elevations 10*b*. In these cases, the ratio between the distances A1 and A2 would be 2:1, 3:1, or 4:1 (up to 10:1).

In accordance with the invention, the surface 8 is provided with additional second structural elevations 10*b* in the region of a planar horizontal surface 20 between first structural elevations 10*a* to prevent contact between the printing material to be transported and the planar horizontal surface 20 located between the first structural elevations 10*a* that are primarily provided for transporting the printing material. Constructing the surface 8 in accordance with the invention also improves what may be referred to as the "emergency functioning" of the surface, which means that if the seal 14 and even the coating 12 are worn and contact between the printing material occurs in the region of the planar horizontal surface 20, potential smearing of the ink can be largely prevented due to the low structural elevations 10*b*.

The distances A1 and A2 range between approximately 50 μm and 500 μm and are preferably approximately 200 μm. A height B1 of the first structural elevations 10*a* is preferably approximately 20 μm, and a height B2 of the second structural elevations 10*b* is preferably approximately 5 μm. A thickness d1 of the coating 12 ranges between approximately 0.5 μm and 20 μm and is preferably less than 5 μm, in particular preferably approximately 2 μm. A thickness d2 of the seal 14 is preferably less than 1 μm. If the seal is a sol-gel seal, the thickness of the seal is preferably in the nanometer range.

FIG. 2 furthermore shows that the coating 12, for example a nickel coating, causes the structural elevations 10*a* and 10*b* to become rounded. An advantage of such rounded structural elevations is that they penetrate less deeply into the printing material to be transported and thus cause less damage (known as "white dots") on the printed image. Another advantage of such rounded structural elevations is that undercuts can be removed and the structure itself can be smoothened, so that when the structured surfaces are washed, the washcloth does not get caught in the structure and there are no lint residues.

The plan view of FIG. 3 illustrates the first and second structural elevations 10*a* and 10*b* and the distances A1 and A2 therebetween. In the preferred exemplary embodiment, the structural elevations 10*a* and 10*b* are disposed in an orthogonal pattern, with the lower structural elevations 10*b* being located precisely between the higher structural elevations 10*a*. Moreover, it can be seen from FIG. 3 that the structural elevations 10*a* and 10*b* have widened bases 22*a* and 22*b* and effective support surfaces 24*a* and 24*b*.

Figure 4:
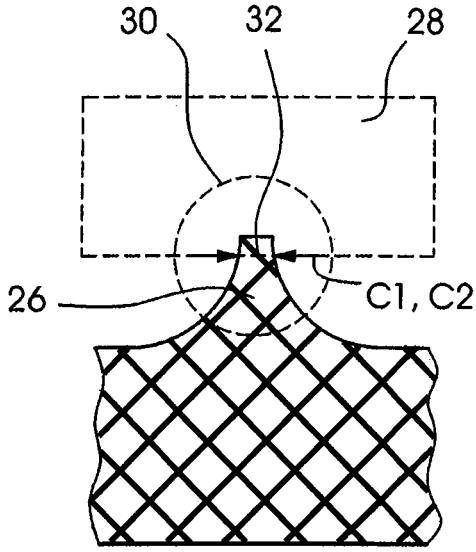
FIG. 4 is a sectional view of a structural elevation of a surface according to the invention.

By way of example, FIG. 4 illustrates a structural elevation that is used to explain the term "effective support surface". The tip of a structural elevation 26 illustrated in FIG. 4 partly penetrates into printing material 28 to be conveyed. The region of the tip of the structural elevation 26 thus forms a support area 30 that comes into contact with the printing material 28 to support and convey the latter. An effective support surface 32 (illustrated in dashed lines in the crosssectional view of FIG. 4), that the structural elevation 26 forms for the printing material 28, depends on the penetration depth of the tip of the structural elevation 26 into the printing material 28, although the structural elevation 26 does not have a planar support surface in the support area 30 on which the printing material 28 could rest. Effective support surfaces of the first structural elevations 10*a* and of the second structural elevations 10*b* are identified as C1 and C2 and are measured in $\mu m^2$. The total support proportion (total of the effective support surfaces) of the surface 8 preferably ranges between approximately 5% and approximately 10%.

As an alternative to the regular distribution of structural elevations as shown in FIG. 3, a random distribution is possible, which advantageously avoids moiré patterns that would be visible to the naked eye in the transported printing material. In accordance with another alternative, the structural elevations of different surfaces or different cylinder sleeves may be evenly distributed, but at different screen angles to avoid moiré effects (in a way similar to the individual color separations).

Furthermore (alternatively or additionally), it is possible to randomly select the diameters of the electrically insulating areas and thus to obtain a random distribution of the heights of the structural elevations.

The invention claimed is:

1. A machine for processing printing material, the machine comprising:

a sheet transport path having a location at which the printing material is processed by offset printing in a sheet fed, lithographic, rotary offset printing press;

a cylinder disposed downstream of said offset printing location along said sheet transport path, said cylinder configured for guiding previously-printed printing material;

a surface provided on said cylinder and having a surface structure configured for contacting the previously-printed printing material;

said surface having first structural elevations being mutually spaced apart by a minimum distance A1 and having a height B1, said first structural elevations being primarily provided for transporting the printing material;

said surface having second structural elevations being mutually spaced apart by a minimum distance A2 and having a height B2, wherein B2<B1 said surface having planar horizontal regions formed between said structural elevations; and a ratio between said distances A1 and A2 ranging between 10:1 and 1:1.

2. The machine according to claim 1, wherein said ratio between said distances A1 and A2 ranges between 5:1 and 1:1.

3. The machine according to claim 1, wherein said ratio between said distances A1 and A2 ranges between 3:1 and 1:1.

4. The machine according to claim 1, wherein said ratio between said distances A1 and A2 ranges between 2:1 and 1:1.

5. The machine according to claim 1, wherein said distance A1 is an average distance between adjacent first structural elevations and said distance A2 is an average distance between adjacent second structural elevations.

6. The machine according to claim 1, wherein said distance A1 and said distance A2 range between approximately 50 μm and approximately 500 μm.

7. The machine according to claim 1, wherein said distance A1 and said distance A2 are approximately 200 μm.

8. The machine according to claim 1, wherein said height B1 ranges between approximately 5 μm and approximately 50 μm, and said height B2 ranges between approximately 2 μm and approximately 25 μm.

9. The machine according to claim 1, wherein said height B1 ranges between approximately 10 μm and approximately 30 μm, and said height B2 ranges between approximately 5 μm and approximately 15 μm.

10. The machine according to claim 1, wherein the machine is a printing press.

11. The machine according to claim 1, wherein some of said structural elevations have planar support surfaces and others of said structural elevations have pointed support surfaces.

12. The machine according to claim 1, which further comprises a coating covering said structural elevations.

13. The machine according to claim 12, which further comprises an ink-repellent seal covering said coating.

14. The machine according to claim 1, wherein said structural elevations have characteristics of elevations produced by electroforming.

15. The machine according to claim 1, wherein said structural elevations are rounded.

16. The machine according to claim 1, wherein said cylinder is a non-printing cylinder.

17. The machine according to claim 1, wherein said surface structure prevents ink from smearing off on said cylinder.

* * * * *